US006651923B2

(12) United States Patent
Kinnunen et al.

(10) Patent No.: US 6,651,923 B2
(45) Date of Patent: Nov. 25, 2003

(54) METHOD AND DEVICE IN A PAPER MACHINE, COATING MACHINE, INTERMEDIATE WINDER, UNWIND STAND OF A SLITTER-WINDER, OR IN ANY OTHER DEVICE FOR TREATMENT OF A WEB

(75) Inventors: Jorma Kinnunen, Helsinki (FI); Silvo Mikkonen, Vantaa (FI); Jukka Linnonmaa, Appleton, WI (US)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/234,586

(22) Filed: Sep. 4, 2002

(65) Prior Publication Data

US 2003/0047641 A1 Mar. 13, 2003

Related U.S. Application Data

(62) Division of application No. 09/555,688, filed as application No. PCT/FI98/00939 on Dec. 2, 1998, now Pat. No. 6,464, 163.

(30) Foreign Application Priority Data

Dec. 4, 1997 (FI) ..... 974417
Mar. 9, 1998 (FI) ..... 980526

(51) Int. Cl.[7] ..... B65H 19/28; B65H 23/26

(52) U.S. Cl. ..... 242/532.2; 242/532.3; 242/615.11; 242/615.2

(58) Field of Search ..... 242/532.2, 532.3, 242/532.7, 548, 615.11, 615.12, 615.2, 555–555.7

(56) References Cited

U.S. PATENT DOCUMENTS

| | | | | | |
|---|---|---|---|---|---|
| 3,527,424 | A | * | 9/1970 | Goldman | 242/532.2 |
| 3,915,399 | A | * | 10/1975 | Kron et al. | |
| 3,925,131 | A | * | 12/1975 | Krause | 242/555 |
| 4,147,287 | A | * | 4/1979 | Reba | 242/532.2 |
| 4,771,962 | A | * | 9/1988 | Gavin et al. | 242/532.2 |
| 4,816,111 | A | * | 3/1989 | Pittarello et al. | 156/504 |
| 4,936,942 | A | * | 6/1990 | Sollinger et al. | 156/504 |
| 4,966,521 | A | * | 10/1990 | Frye et al. | 414/788.8 |
| 5,014,924 | A | * | 5/1991 | Nowisch et al. | 242/532.3 |
| 5,318,237 | A | * | 6/1994 | Lotto et al. | |
| 5,452,496 | A | * | 9/1995 | Long et al. | 242/532.2 |
| 5,511,712 | A | * | 4/1996 | Holm et al. | 226/11 |
| 5,650,010 | A | * | 7/1997 | Rantanen et al. | 118/224 |
| 5,709,355 | A | * | 1/1998 | Kinnunen et al. | 242/555.3 |
| 5,797,559 | A | * | 8/1998 | Coffey | 242/532.2 |
| 5,833,168 | A | * | 11/1998 | Tahata et al. | 242/555.5 |

FOREIGN PATENT DOCUMENTS

| | | | |
|---|---|---|---|
| EP | 0505712 | * | 9/1992 |
| EP | 0611716 | * | 8/1994 |
| FI | 93665 | * | 1/1995 |
| FI | 94883 | * | 7/1995 |
| GB | 2093808 | * | 9/1982 |
| GB | 2272850 | * | 6/1994 |
| WO | WO 9425382 | * | 11/1994 |

* cited by examiner

*Primary Examiner*—John M. Jillions
(74) *Attorney, Agent, or Firm*—Steinberg & Raskin, P.C.

(57) ABSTRACT

The invention concerns a method and a device in a paper machine, coating machine, intermediate winder, unwind stand of a slitter-winder, or in any other device for treatment of a web. In the event of disturbance, the web (P) is made to be wound in a controlled way around at least one web guide roll (18*a*).

16 Claims, 7 Drawing Sheets

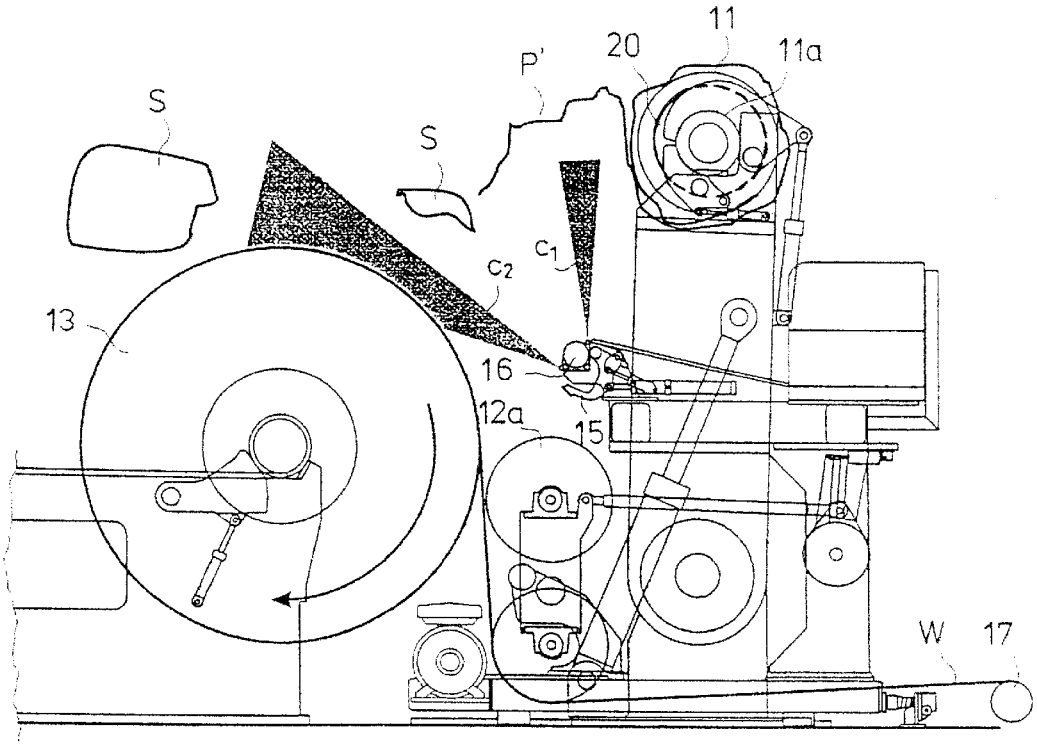
FIG. A
PRIOR ART

METHOD AND DEVICE IN A PAPER MACHINE, COATING MACHINE, INTERMEDIATE WINDER, UNWIND STAND OF A SLITTER-WINDER, OR IN ANY OTHER DEVICE FOR TREATMENT OF A WEB

This application is a division of application Ser. No. 09/555,688, filed Sep. 22, 2000, now U.S. Pat. No. 6,464, 163, which is a 371 of PCT/FI98/00939, filed Dec. 2, 1998.

FIELD OF THE INVENTION

The invention concerns a method in a paper machine, coating machine, intermediate winder, unwind stand of a slitter-winder, or in any other device for treatment of a web.

A particular subject of the invention is a method in splicing in a continuous unwind stand, in which method the web on a new machine reel to be introduced in the unwind stand is joined at full speed with the web of the machine reel that is being emptied by cutting off the web and by pressing the web of the machine reel that is being emptied into contact with the splice provided on the new machine reel.

A second particular subject of the invention is a method in equipments for coating of a paper web, in which method the paper web is coated with a layer of paste from at least one side by making the paper web pass through at least one coating station and through at least one dryer section, and in which method the running of the paper web to be coated is monitored by means of at least one monitoring device, the cutting off of the paper web to be coated being carried out based on a signal transmitted by said monitoring device.

The invention also concerns a device in a paper machine, coating machine, intermediate winder, unwind stand of a slitter-winder, or in any other device for treatment of a web.

A particular subject of the invention is also a device in splicing in a continuous unwind stand, in which the web on a new machine reel to be introduced in the unwind stand is joined at full speed with the web of the machine reel that is being emptied by cutting off the web and by pressing the web of the machine reel that is being emptied into contact with the splice provided on the new machine reel.

A second particular subject of the invention is also a device in equipments for coating of a paper web, by means of which coating machine the paper web is coated with a layer of paste from at least one side by making the paper web pass through at least one coating station and through at least one dryer section, and in which coating machine the running of the paper web to be coated is monitored by means of at least one monitoring device.

BACKGROUND OF THE INVENTION

In off-machine coating machines, a continuous unwind stand is used in which the new machine reel to be introduced in the unwind stand is joined at full speed with the tail of the machine reel that is being emptied. In modem high-speed coating machines, the splicing method is, in principle, the same irrespective of the manufacturer of the machine. At the end of the web on the new machine reel, in advance, a splice is prepared by means of double-sided adhesive tape, which splice is attached to the reel face by means of pieces of adhesive tape. The circumferential speed of the new machine reel is raised to a level equal to the running speed of the machine, after which the web of the machine reel that is being emptied is pressed into contact with said splice, for example, by means of a roll or brush. The old web is cut off by means of a blade from above the splice.

The splicing in an unwind stand has become problematic at the current running speeds (1200 . . . 1600 meters per minute). Out of this reason, the running speed of the splicing machine is often lowered for the time of splicing. At a high speed, a vacuum is formed in the what is called splicing gap placed between the machine reel and the splicing roll brought to the vicinity of said reel, which vacuum can be pulsating if the new machine reel is non-circular. The vacuum tends to attract the old web partly into contact with the splice even before splicing, and the vacuum also causes fluttering of the old web. Further, the vacuum tends to separate the tape splice from the face of the new machine reel, in which case the new machine reel is opened before splicing. In order that the running of the web should be controlled, at the splicing roll a bend is required, which again requires stretching of the web when the splicing roll is hit quickly onto the face of the new machine reel. Attempts are made to keep the tension peak caused by the hitting of the roll in splicing low by using a little splicing gap (8 . . . 12 mm), which produces an intensive vacuum effect. Even the bending angle that is used currently causes a problematic tension peak in the web. At higher running speeds an even larger bending angle would be required.

In the FI Patent Application No. 942869, a splicing device for a continuous unwind stand is described, by whose means the new machine reel brought to the unwind stand is connected at full speed with the web of the machine reel that is being emptied. The splicing device comprises a splicing roll, by whose means the web of the machine reel that is being emptied is pressed into contact with the splice placed on the new machine reel, and at least one second roll. The splicing roll and said second roll are attached to a lever device, which is mounted by means of an articulation point placed between the shafts of said rolls, so that the run of the web before splicing and the run of the web during splicing are such that the length of the web during splicing and when said rolls are in their basic positions is substantially equal.

At high running speeds and in particular with heavy paper grades, in flying splicing, a problem has been the control of the cut-off tail of the old machine reel. After the splicing, attempts are made to stop the reel spool that is being emptied quickly. Paper must not be unwound to such an extent that it cannot be controlled by means of blowing of air. The tail of the cut-off web and any paper chips must be kept away from the splicing nip. If the cut-off tail ends up onto the web, it causes a web break. Also smaller paper chips can cause a web break if chips are carried along with the web, for example, to a coating station. Even if a paper chip separated from the tail did not cause a web break, it, however, causes cleaning work after splicing.

In order to solve this problem, some manufacturers have constructed inverted unwind stands, in which the geometry has been turned upside down. It is the purpose of the inverted geometry that, after the splicing, the cut-off tail and any paper chips that are separated fall away from the web by the effect of gravity. At higher speeds (higher than 1400 meters per minute), even this is not of any use, because the air flows present on the faces of the departing web and of the large machine reel that is being unwound are so intensive that the direction of the gravity remains insignificant.

Traditionally, for the control of the cut-off web, blowings have been employed, by whose means attempts are made to guide the tail around the reel spool to be slowed down and to prevent access of the tail and of separated chips to the departing web. Attempts are made to stop the reel spool that is being emptied by means of mechanical brakes quickly. This requires high capacity from the brakes and, thereby, causes rapid wear of the brakes. The brake pads of the brakes must be renewed frequently. At present, a typical stopping time of about 4 seconds is in use. With the present-day technology, a target time for stopping the reel would be about 1.5 seconds, irrespective of the speed or of the size of the reel spool. In large machines, such a time would involve a braking capacity of up to 10 MW. At present, there are production machines in which the brake devices must be replaced even at intervals of 2 months, which means, among other things, a considerable expense in terms of money.

In very narrow unwind stands (width about 1 meter) of the revolver type, which are used at printing machines, occasionally, a double-sided tape is used on an intermediate roll placed before the cut-off roll, which tape captures the cut-off tail around it. After splicing, the intermediate roll is unwound and cleaned manually. The tape is difficult to remove from the intermediate roll, but this is necessary after each splicing cycle. In large high-speed unwind stands (roll diameter $\phi$=1000 mm, length 8000 mm) such fitting of tapes and manual cleaning are directly impossible, because there is not time enough for the necessary manual cleaning between splicing cycles.

In machines for coating of a paper web, first a layer of paste is applied onto the paper web by means of an applicator device, and after that the coating is smoothed by means of a doctor blade against the same backup roll.

In the Finnish Patent No. 93,665, a method and an equipment are described for coating of a paper web, wherein the application and the smoothing proper are arranged so that each process has a backup face of its own. Of the backup faces, at least the latter one drives the web or moves at least substantially at the same speed as the web. By means of independent backup faces, it is possible to control the tension of the web placed between the holding points and to prevent detrimental bag formation in, or slackening of, the web between the holding points.

In the Finnish Patent No. 94,883, a method and an equipment are described for double-sided coating of a thin printing-paper web that contains mechanical pulp. In this prior-art method, the first side of the web is coated by means of a first coating station, the first coating layer is dried at least partly by means of a drying equipment, and the second side of the web is coated, after drying of the first side, by means of a second coating station, and the second coating layer is dried at least partly by means of a second drying equipment. The first and the second coating layer are formed by applying the necessary amount of coating agent onto the face of a film roll, from which the coating agent is transferred onto the web in a nip between a backup roll and the film roll. The drying equipment can consist of infrared dryer units and of drying cylinders.

As is well known, in paper web coating machines, air dryers, i.e. airborne web dryers, have also been employed.

Clearing up of web breaks taking place in a coating machine requires an abundance of time from the operating team, and losses in production arise. The clearing up of a web break mainly consists of the following steps of work:

Clearing of paper chips from the machine, in particular from between the airborne web dryers.

Washing of the coating stations.

In order that winding of the web around the backup rolls could be avoided, which winding might damage the rubber-coated backup rolls, the coating machine is typically provided with a web break monitoring system and with cutter blades before each coating station. When it operates correctly, this system protects the backup rolls but may, otherwise, cause even more paper chips to be cleared from the machine than without web break monitoring. This comes from the fact that the web tension goes down to zero after the cutter blade has cut off the web, in which connection the free tail moves readily to the sides, is cut off when it strikes against the frames, and remains in its place, e.g., inside the airborne web dryers. Corresponding situations in which the control of the web is lost, in the event of a web break or when the web is cut off intentionally, also occur, among other things, in intermediate winders, slitter-winders, and even in paper machines in some cases.

SUMMARY OF THE INVENTION

The general object of the present invention is to provide an improvement of the prior-art methods and devices in a paper machine, coating machine, intermediate winder, unwind stand in a slitter-winder, or in any other device for treatment of a web in which detrimental disturbance may occur.

It is a particular object of the present invention to provide an improvement of the prior-art methods and devices in splicing in a continuous unwind stand.

It is a more specific object of the invention to provide a method and a device in splicing in a continuous unwind stand, in which the numerous adverse factors occurring in the prior-art solutions have been avoided.

It is a second particular object of the present invention to provide an improvement over the prior-art methods and devices in paper web coating machines.

It is a more specific object of the present invention to provide a method and a device which permit a substantial reduction of the quantity of broke from web break.

The method in accordance with the invention is characterized in that, in the event of disturbance, the web is made to be wound in a controlled way around at least one web guide roll.

A method in accordance with the invention is characterized in that the cut-off final end of the web on the machine reel that is being emptied is made to adhere to an intermediate roll placed before the cutter blade by means of suction while said intermediate roll revolves at the unwind speed.

A second method in accordance with the invention is characterized in that, controlled by the signal transmitted by the monitoring device, the cut-off web is made to be wound in a controlled way around a pick-up roll placed in the coating equipment.

The device in accordance with the invention is characterized in that the device comprises at least one web guide roll around which the web is made to be wound in a controlled way in the event of disturbance.

A device in accordance with the invention is characterized in that the device comprises an intermediate roll placed before the cutter blade, which intermediate roll comprises means for producing winding of the cut-off final end of the web onto said intermediate roll while said intermediate roll revolves at the unwind speed.

By means of the present invention, among other things, the necessity, characteristic of the prior-art solutions, to stop the old reel spool quickly is avoided, in which case the wear of the brake devices is less intensive, and equally large or efficient brake devices are not needed.

A device in accordance with the invention in connection with a coating equipment is characterized in that the device includes a pick-up roll, which comprises means for making the cut-off web to be wound around said pick-up roll.

In accordance with preferred embodiments of the invention, the pick-up roll is placed, in an off-machine coating machine, before the coating station and/or after air dryers.

In the commonest embodiment of the invention, in a paper machine, coating machine, intermediate winder, unwind stand of a slitter-winder, or in any other device for treatment of a web, at least one web guide roll is employed, around which the web is made to be wound in a controlled way in the event of disturbance. The web guide roll is preferably a suction roll. In connection with the web guide roll, if necessary, for example, an air foil box can be fitted. In the vicinity of the web guide roll, it is favourable to fit a plate-like member, which extends substantially across the entire width of the web guide roll in the cross direction. The plate-like member preferably comprises a first plate portion, which extends in the running direction of the arriving web at a distance from the path of running of the web. The plate-like member preferably also comprises a second plate portion, which extends along the face of the web guide roll at a distance from the web guide roll. The plate-like member can be provided with holes in order to permit flow of air through the plate-like member.

According to a preferred embodiment of the invention, before the cutter blade, an intermediate roll has been fitted, which comprises members for making the cut-off final end of the web to adhere to the intermediate roll while the intermediate roll revolves at the unwind speed. In a preferred embodiment of the invention, the intermediate roll is a suction roll, into which a vacuum is passed in connection with the splicing. The suction in the suction roll can be activated substantially at the time of reel change only, or, as an alternative, a constant slight vacuum is maintained in the suction roll in order to stabilize the run of the web, and substantially at the time of reel change the suction roll is subjected to an intensive suction.

An embodiment with a suction roll can be accomplished most advantageously so that an invariable vacuum is set for the suction roll, which vacuum is sufficient to suck the tail around the roll in a situation of reel change, but which vacuum does, however, not cut off the web or have an interfering effect on the run of the web during normal running.

In a second preferred embodiment of the invention, a fluid that increases the adhesion is applied to the intermediate roll placed before the cutter blade. Such a moistening jet affixes the cut-off final end of the web reliably to the intermediate roll. The reel spool of the machine reel that is being emptied is braked down by means of a brake generator and/or by means of a mechanical brake under control, so that the cut-off final end of the web can be wound back onto the reel spool of the emptied machine reel, for example, by means of a secondary winding drive. A mechanical brake is used in small unwind stands only. A brake generator is the most advantageous solution, in which connection the centre drive operates as the brake.

According to a further preferred embodiment of the invention, in connection with the intermediate roll placed before the cutter blade, an air foil box has been fitted, by whose means, after cutting off of the web, the final end of the cut-off web is made to be wound around the intermediate roll. The cut-off final end is guided by means of an air foil box fitted in connection with the intermediate roll and by means of air blowings arranged in said box, so that the web end is wound onto the intermediate roll placed before the cutter blade while said intermediate roll revolves at the unwind speed.

In the vicinity of the face of the intermediate roll, air jets favourably parallel to the sense of rotation of the roll as well as a carrier face have been fitted, which carrier face extends a certain distance around the roll, preferably almost from the web cut-off point to the vicinity of the nip between the roll and the web. Favourably, by means of an air jet provided in the air foil box next to the cutter blade, the cut-off tail is guided by means of a coanda effect into the space formed by the air foil box and the intermediate roll and further to around the intermediate roll.

In the present invention, it has been realized to make use of the signal given by the web break monitoring system so that, based on the signal given by the monitoring device, besides cutting-off of the web, a control impulse is also given to some actuator, such as, for example, actuators fitted on a roll or rolls, by means of which actuator the cut-off web can be wound in a controlled way around the roll. In the solution in accordance with the invention, the web break is detected favourably so that (a pair of) photocells detects that the web "is lost" from between and/or measurement of web tension detects that the web tension "is lost". In the method and the device in accordance with the present invention, the free final end or tail of the cut-off web is wound around a paper guide roll placed ahead of the cutter blade, in which case the web does not remain, for example, in airborne web dryers, for example, in connection with cutting off, and therefore it is easier to clean the coating machine. The web wound around the roll can also be unwound from the roll directly, for example, onto the broke conveyor or into the pulper, and a web break can be cleared up with very quick cleaning. Owing to the realization in accordance with the present invention, for example, in a paper mill, economies of millions of Finnish Markkas are obtained in a year in terms of shorter web break times or in the form that the invention permits running of the coating machine with an operating team of fewer persons than in the prior art.

A very little amount of broke to be cleared is achieved in off-machine coating machines if the web is wound around a pick-up roll placed before the web break point and if the machine portion that precedes the roll is slowed down in a controlled way so that the web remains whole. In such a case, the web also remains whole in the unwind stand, which reduces the amount of broke that is formed significantly. After the break, the web can be wound back to the unwind stand, or it can be unwound in a controlled way, for example, into the basement.

As the pick-up roll, it is advantageously possible to use the roll solutions described in the same applicant's Finnish Patent Application No. 974417 (filed Dec. 4, 1997).

In a preferred embodiment of the invention, the pick-up roll is a suction roll, into which an intensive vacuum is passed substantially at the time of web cut-off.

In a second preferred embodiment of the invention, a constant slight vacuum is maintained in the suction roll to stabilize the running of the web, and substantially at the time of web cut-off an intensive vacuum is passed into the suction roll.

In a third preferred embodiment of the invention, a vacuum that has been set invariable is maintained in the suction roll, which vacuum is sufficient to suck the cut-off web to around the suction roll at the time of web cut-off, but which vacuum does, however, not cut off the web or have an interfering effect on the run of the web during normal running.

According to a fourth preferred embodiment of the invention, a moistening jet that increases the adhesion is applied onto the pick-up roll. Such a moistening jet affixes the cut-off web reliably onto the pick-up roll.

According to a fifth preferred embodiment of the invention, the cut-off web is guided, by means of an air foil box fitted in connection with the pick-up roll and by means of blowings of air fitted in said box, so that it is wound onto the pick-up roll placed before the cutter blade. In the vicinity of the face of the pick-up roll, air jets parallel to the sense of rotation of the pick-up roll as well as a carrier face have been fitted, which carrier face extends a distance around the pick-up roll. By means of the air jet placed nearest to the cutter blade, the cut-off web is guided by means of a coanda effect into the space formed by the air foil box and the pick-up roll and further to around the pick-up roll.

BRIEF DESCRIPTION OF THE DRAWINGS

The invention will be described in detail with reference to some preferred embodiments of the invention illustrated in the figures in the accompanying drawings, the invention being, however, not supposed to be confined to said embodiments alone.

FIG. A is a side view illustrating a prior-art method and device in splicing in a continuous unwind stand.

DETAILED DESCRIPTION OF THE INVENTION

Figure 1A:
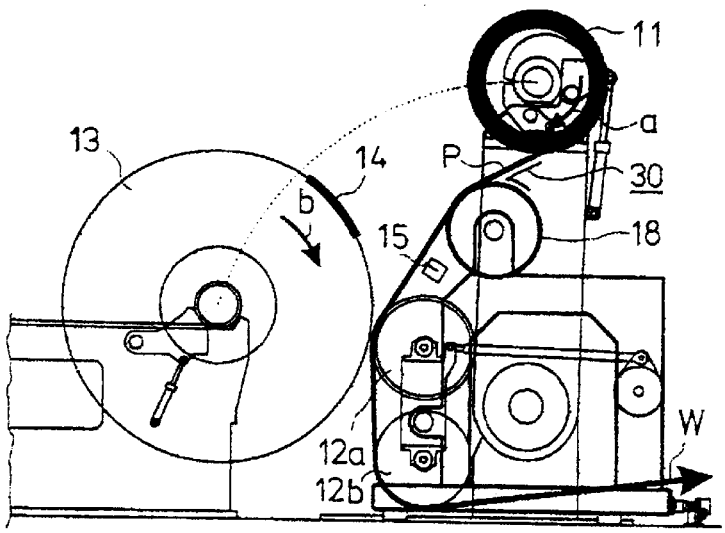
FIGS. 1A, 1B and 1C are side views illustrating a preferred embodiment of the method and the device in accordance with the present invention.

In the prior-art solution as shown in FIG. A, the machine reel that is being emptied is denoted with the reference numeral 11, the splicing roll with the reference numeral 12*a,* and the paper guide roll with the reference numeral 17, as well as the new machine reel with the reference numeral 13. The web P is cut off by means of the cutter blade 15. After splicing, the web runs to a coating machine (not shown). The run of the web to the coating machine is denoted with the letter W. The reference numeral 20 refers to the brake device. The reference numeral 16 refers to the blow device, which applies the blow jets $c_1$ and $c_2$. By means of the blow jets $c_1$ and $c_2$, attempts are made to raise the cut-off final end of the web P, i.e. the tail P', to around the reel spool 11*a* of the machine reel 11 that is being emptied and to prevent access of paper chips S into the splicing nip. FIG. A, which represents the prior art, shows the situation after splicing in a prior-art splicing solution.

Figure 1B:
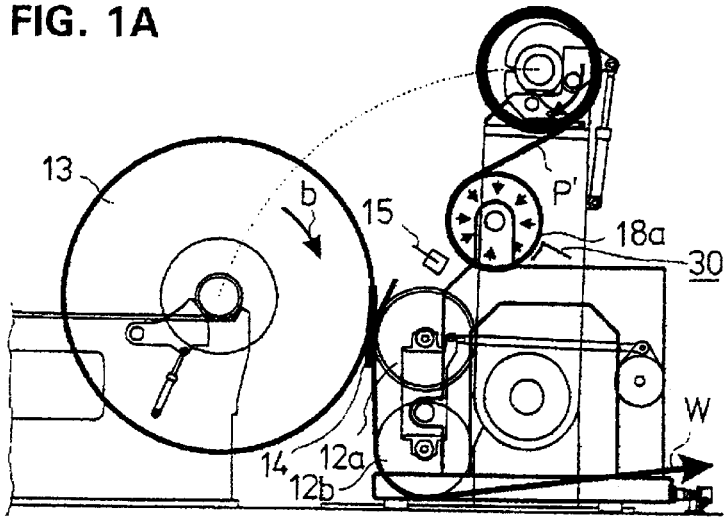
Figure 1C:
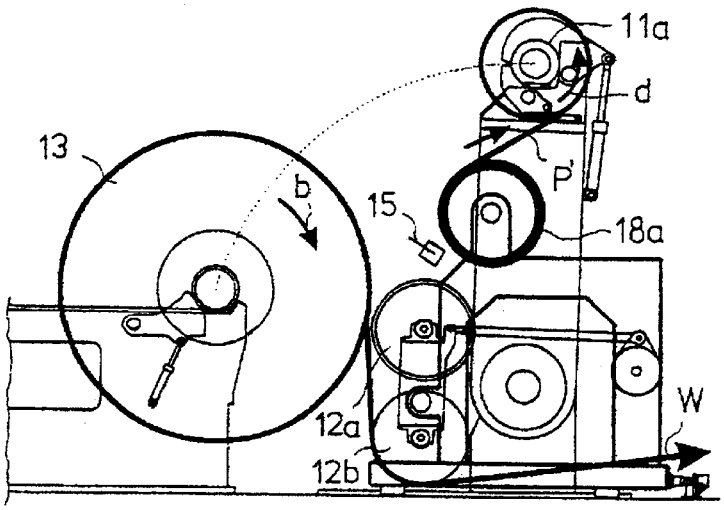

A preferred embodiment of the method and the device in accordance with the present invention is shown in FIGS. 1A, 1B and 1C. FIG. 1A illustrates unwinding before splicing, FIG. 1B illustrates the splicing process, and FIG. 1C illustrates the situation after splicing. In FIGS. 1A . . . 1C, the tape splice is denoted with the reference numeral 14, and the cutter blade with the reference numeral 15. The sense of rotation of the machine reel 11 that is being emptied is denoted with the arrow a, and the sense of rotation of the new machine reel with the arrow b.

In the method in accordance with the invention, before the cutter blade 15, the intermediate roll 18 is placed, which is a suction roll 18*a* in the embodiment as shown in FIGS. 1A . . . 1C. As is seen from FIG. 1B, the cut-off web P' is wound around the intermediate roll, i.e. around the suction roll 18*a* in this embodiment. The old web, i.e. the cut-off web P' is wound back onto the reel spool 11*a* of the emptied machine reel 11, in which connection the reel spool revolves in the sense indicated by the arrow d, as is illustrated in FIG. 1C.

Figure 2:
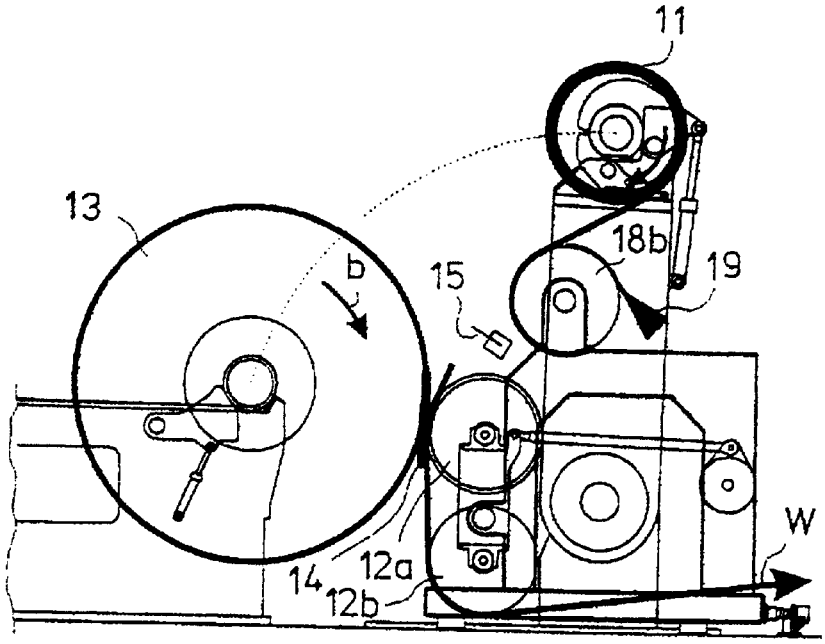
FIG. 2 is a side view illustrating a second preferred embodiment of the method and the device in accordance with the present invention.

In the embodiment shown in FIG. 2, as the intermediate roll 18, an intermediate roll 18*b* is used on whose face there is a fluid which increases the adhesion. In FIG. 2, the feed of the fluid which increases the adhesion, which feed is preferably a moistening jet, is denoted with the reference numeral 19. In the other respects, the mode of operation of the embodiment shown in FIG. 2 is fully similar to the embodiment shown in FIGS. 1A . . . 1C.

Figure 3:
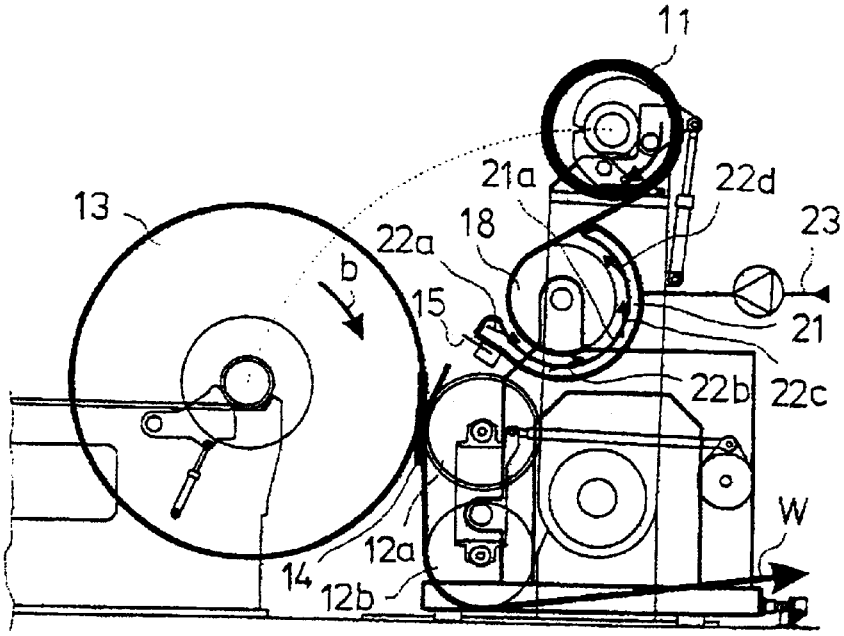
FIG. 3 is a side view illustrating a third preferred embodiment of the method and the device in accordance with the present invention.

In the embodiment as shown in FIG. 3, in connection with the intermediate roll 18 placed before the cutter blade 15, an air foil box 21 has been fitted, by whose means, upon cutting off of the web, the final end P' of the cut-off web is made to be wound around the intermediate roll 18. The cut-off final end P' is guided by means of the air foil box 21 fitted in connection with the intermediate roll 18 and by means of air blowings 22*a* . . . 22*d* arranged in said box to be wound onto the intermediate roll 18 placed before the cutter blade 15 while the intermediate roll 18 revolves at the unwind speed. The reference numeral 23 refers to the feed line through which air is passed into the air foil box 21.

As is shown in FIG. 3, in the vicinity of the face of the intermediate roll 18, air jets 22*a* . . . 22*d* parallel to the sense of rotation of the intermediate roll 18 as well as a carrier face 21*a* have been fitted, which carrier face extends a distance around the intermediate roll 18, preferably almost from the web cut-off point to the vicinity of the nip N between the intermediate roll 18 and the web. Favourably, by means of the air jet 22*a* placed in the air foil box 21 nearest to the cutter blade 15, the cut-off tail P' is guided by means of a coanda effect into the space formed by the air foil box 21 and the intermediate roll 18, and further to around the intermediate roll 18.

In the embodiments as shown in FIGS. 1A . . . 1C, 2, and 3, it is possible to use, for example, the splicing device described in the FI Patent Application No. 942869, in which there is, besides the splicing roll 12*a,* at least one second roll 12*b.*

Figure 4:
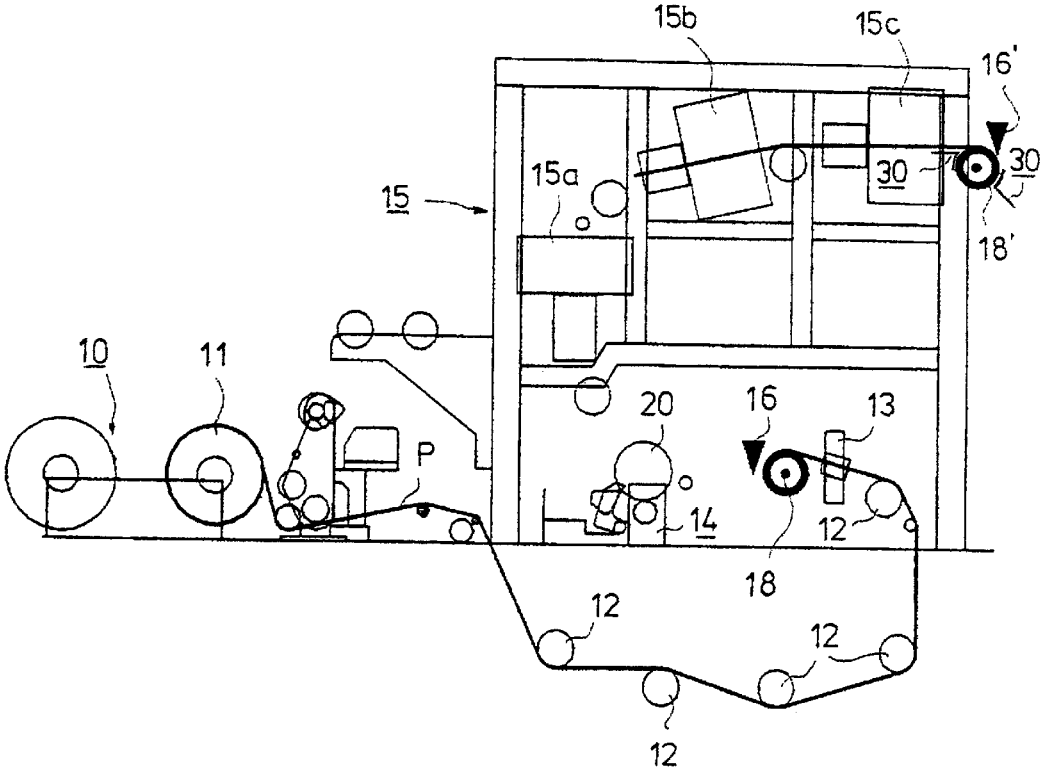
FIG. 4 is a schematic side view of a fourth preferred embodiment of the method and the device in accordance with the present invention.
Figure 5:
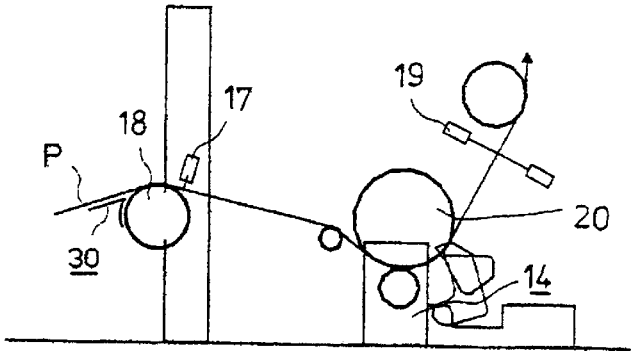
FIG. 5 is a schematic side view of the web break control devices employed in the method in accordance with the present invention.

In the embodiment shown in FIGS. 4 and 5, the unwind stand is denoted generally with the reference numeral 10. The web P is passed from the machine reel 11 over the guide rolls 12 into the coating station, which is denoted generally with the reference numeral 14. Before the coating station 14, there is a measurement beam 13, which comprises a web P monitoring system. The web P break point is denoted with the reference numeral 16, and the cutter blade with the reference numeral 17. The pick-up roll in accordance with the invention is denoted with the reference numeral 18, and the monitoring cell provided in the measurement beam 13 with the reference numeral 19. The backup roll in the coating station 14 is denoted with the reference numeral 20. After coating, the coated web continues its run from the coating station 14 into the dryer section, which is denoted generally with the reference numeral 15. In this embodiment, the dryer section 15 comprises the dryers 15*a*,15*b*,15*c*. Also in the dryer section 15, a second pick-up roll in accordance with the invention has been fitted, said roll being denoted with the reference numeral 18'. In this embodiment, the second pick-up roll 18' has been fitted after the dryers 15*a*,15*b*,15*c*, and the web break point is denoted with the reference numeral 16'.

In the embodiment as shown in FIGS. 4 and 5, the running of the web P is monitored at least before the coating station 14 and/or also in the dryer section 15. Based on the signal given by the monitoring cell 19, the cutter blade 17 cuts off the web P, and the cut-off web P' is made to be wound around the pick-up roll 18, and around the pick-up roll 18', respectively. In the method and the device in accordance with the invention, based on the signal given by the monitoring cell 19, first or directly after the cut-off impulse, the actuator is controlled, by means of which actuator the web can be made to adhere to the pick-up roll 18 and, thus, to be wound around the roll. The drive of the pick-up roll 18 and of the pick-up roll 18', respectively, can be kept at an invariable speed, or it can even be accelerated in order that the web tension should be retained and the web be wound as whole as possible to around the pick-up roll 18 and around the pick-up roll 18', respectively. After this, the web can be unwound from the pick-up roll 18 and from the pick-up roll 18', respectively, by rotating the drive in the reverse direction, onto the floor, the broke conveyor, or directly into the pulper.

In the embodiment as shown in FIGS. 4 and 5, by way of example, the control of broke resulting from web break in the first coating station 14 in an on/off-machine coating machine is illustrated. If the web P is broken at the first coating station 14, the web is wound onto the pick-up roll 18 that precedes the first coating station 14, in which case the web remains whole right from the unwind stand 10. The pick-up roll 18' placed after the dryer section 15, for example the airborne web dryers 15*a*, 15*b*,15*c*, collects the web away from the airborne web dryers 15*a*,15*b*,15*c*.

Figure 6A:
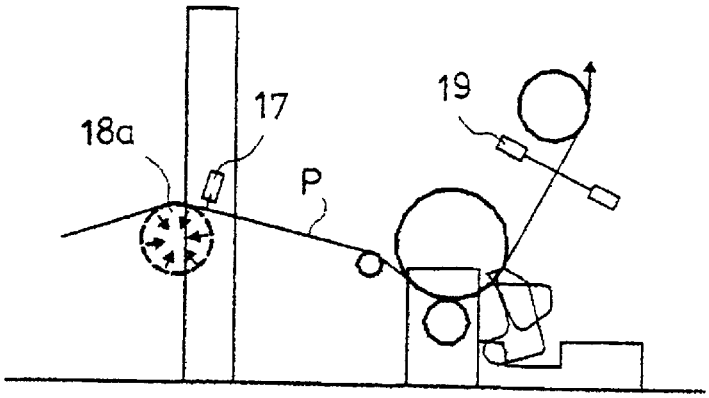
FIGS. 6A and 6B are side views of a fifth preferred embodiment of the method and the device in accordance with the present invention.
Figure 6B:
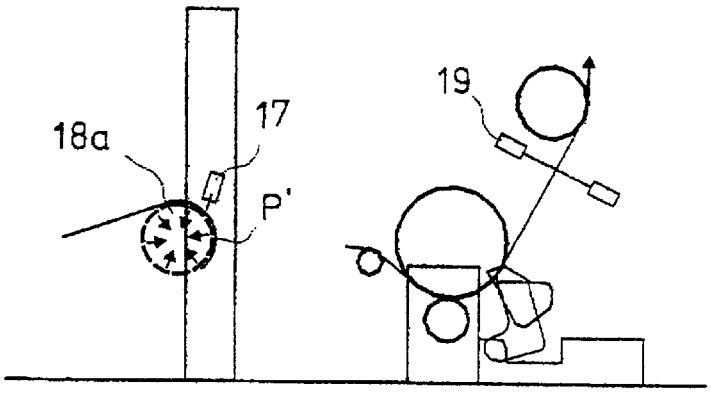

In a preferred embodiment of the method and the device in accordance with the invention, before the cutter blade 17, there is a paper guide roll 18 which operates as a pick-up roll and which is a suction roll 18*a* in the embodiment shown in FIGS. 6A and 6B. As is seen from FIG. 6B, the cut-off web P' is wound around the suction roll 18*a*. The web P can be cut off by means of the cutter blade 17 after the suction roll 18*a* (if there is time enough). If the web P breaks, for example, at the following coating station, the suction roll 18*a* can pull the web around the roll if a constant slight suction is maintained in the suction roll 18*a*.

Figure 7A:
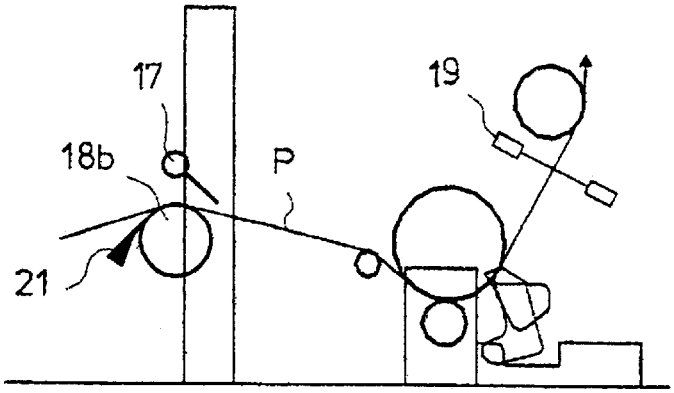
FIGS. 7A and 7B are side views of a sixth preferred embodiment of the method and the device in accordance with the present invention.
Figure 7B:
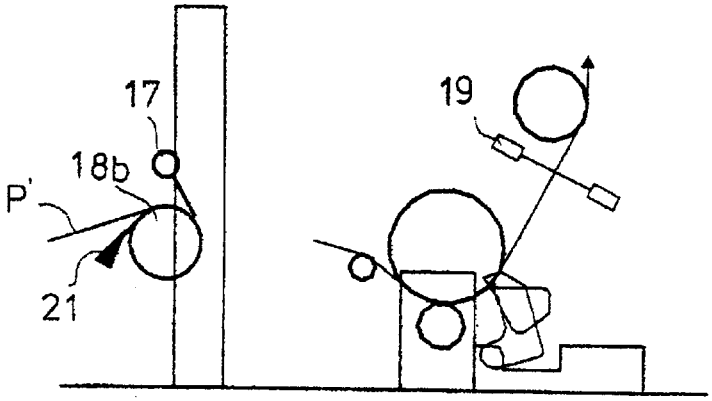

In the embodiment as shown in FIGS. 7A and 7B, as the paper guide roll 18 that operates as the pick-up roll, a roll 18*b* is used on whose face there is a fluid that increases the adhesion. In FIGS. 7A and 7B, the feed of the fluid that increases the adhesion, which feed is favourably a moistening jet, is denoted with the reference numeral 21. As is seen from FIG. 7B, the cutter blade 17 is preferably fitted to press the cut-off web P' into contact with the roll 18*b*.

Figure 8A:
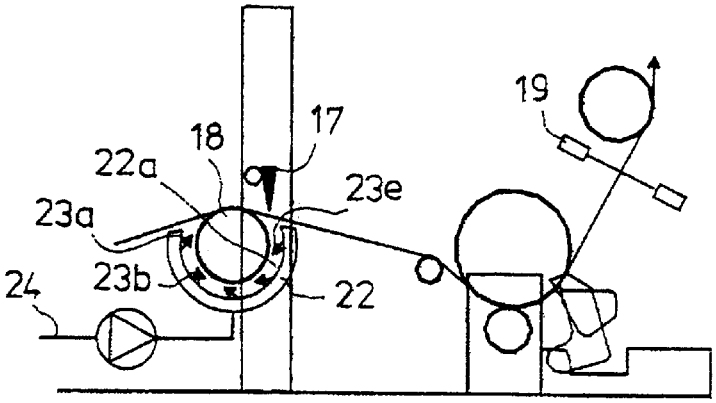
FIGS. 8A and 8B are side views of a seventh preferred embodiment of the method and the device in accordance with the present invention.
Figure 8B:
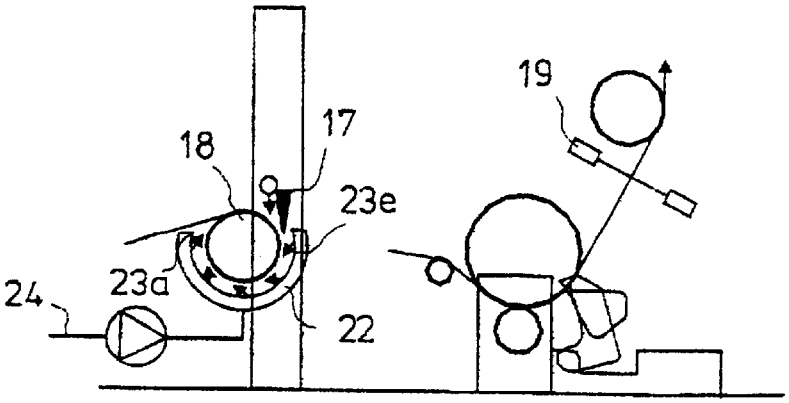

In the embodiment shown in FIGS. 8A and 8B, in connection with the paper guide roll 18 which is placed before the cutter blade 17 and which operates as the pick-up roll, an air foil box 22 has been fitted, by whose means, after the web P has been cut off, the cut-off web P' is made to be wound around the roll 18. The cut-off web P' is guided, by means of the air foil box 22 fitted in connection with the roll 18 and by means of blowings of air 23*a* . . . 23*e* arranged in said box, to be wound onto the roll 18 that is placed before the cutter blade 17. The reference numeral 24 refers to the feed line through which air is passed into the air foil box 22.

As is shown in FIGS. 8A and 8B, in the vicinity of the roll 18 face, air jets 23*a* . . . 23*e* parallel to the sense of rotation of the roll 18 as well as a carrier face 22*a* have been fitted, which carrier face extends a distance around the roll 18, preferably substantially from the web cut-off point to the vicinity of the nip between the roll 18 and the web. Advantageously, by means of the air jet 23*a* placed in the air foil box 22 nearest to the cutter blade 17, the cut-off web P' is guided, e.g., by making use of a coanda effect, into the space formed by the air foil box 22 and the roll 18 and further to around the roll 18.

Figure 9:
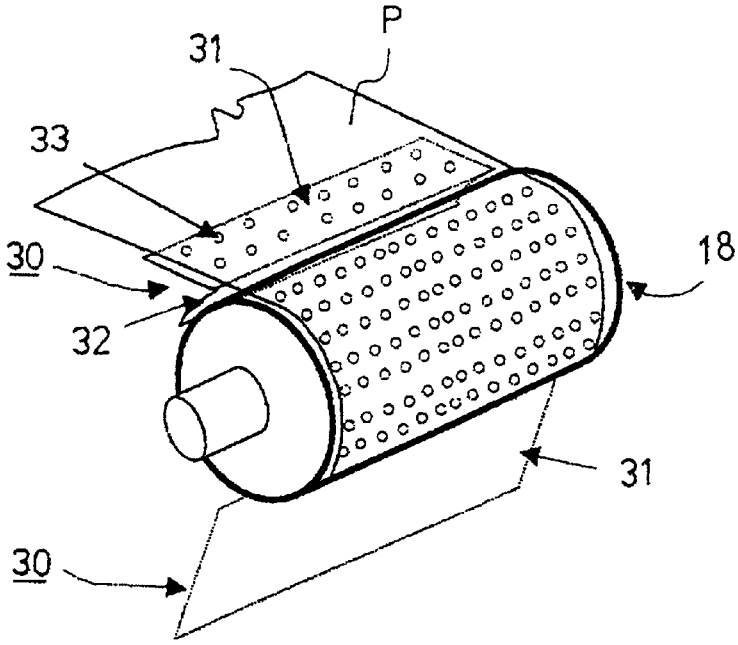
FIG. 9 is an axonometric illustration of a preferred embodiment of the web guide roll in accordance with the invention.

The plate-like component 30 shown in FIG. 9 can be used in connection with any web guide roll 18 whatsoever. In the embodiment as shown in FIG. 9, for example, a plate-like construction fitted in the vicinity of the pick-up roll 18 or 18' extends substantially across the width of the whole pick-up roll in the cross direction. The plate-like component 30 favourably comprises a portion 31 which extends in the direction of running of the arriving web P at a distance from the path of running of the web, or, alternatively, in the direction of the radius of the roll 18 in some other direction, as is indicated in FIG. 9 by the dotted lines. The plate-like component 30 favourably also comprises a portion 32, which extends along the face of the pick-up roll 18 or 18' at a distance from the pick-up roll. In some practical applications, in particular if the cutting off of the web has to be carried out at a distance from the pick-up roll, the cut-off end of the web that was cut off by means of the cutter device 16,16',17 remains apart from the pick-up roll, in which case this end may cause difficulties in the closing gap of the web to be wound onto the pick-up roll. In particular the relatively long cut-off end of the web may be torn and then drift into the closing gap of the web to be wound onto the pick-up roll. By means of the plate-like component 30 suggested herein, the closing gap area is covered, whereby access of paper that may be formed in between the layers of the paper that is being wound is prevented. Depending on the particular application, the plate-like component 30 can be made, for example, of a solid plate or of a perforated plate, in which case it permits flow of air through the plate. The perforations provided in the plate-like member 30 shown in FIG. 9 are denoted with the reference numeral 33, and said perforations can be present in either one of the plate portions 31 or 32 or in both of the plate portions 31 and 32.

In unwind stand applications, the plate-like member 30 as shown in FIG. 9 should preferably be placed, for example, in the way illustrated in FIG. 1A or in FIG. 1B. In coating machine applications, the plate-like member is preferably placed, for example, in the way illustrated in FIGS. 4 and 5.

Above, just some preferred embodiments of the invention have been described, and it is obvious to a person skilled in the art that numerous modifications can be made to said embodiments within the scope of the inventive idea stated in the accompanying patent claims.

We claim:

1. A method in a paper machine, coating machine, intermediate winder, unwind stand of a slitter-winder, or any other device for the treatment of a paper web, comprising the steps of:

guiding a paper web, in the event of a disturbance, in a controlled manner around at least one web guide roll;

wherein a suction roll is used as said guide roll; and maintaining a constant slight vacuum in said suction roll in order to stabilize the run of the web and then creating an intensive vacuum in said suction roll substantially at the time of said disturbance.

2. The method according to claim 1, further comprising:

maintaining a vacuum in said suction roll, said vacuum having a strength which is selected so that it is strong enough to suck a cut off final end of said web around the suction roll at a time of a reel change but said vacuum not being so strong so as to interfere with the run of the web during normal running.

3. The method according to claim 1, further comprising:

applying a fluid to web guide roll to increase adhesion of the web.

4. The method according to claim 1, further comprising:

directing an air flow in the vicinity of a face of the guide roll by means of airjets arranged parallel to a sense of rotation of the web guide roll.

5. The method according to claim 4, further comprising:

arranging a carrier face to extend a distance around the web guide roll.

6. A device in a paper machine, coating machine, intermediate winder, unwind stand of a slitter winder, or in any other device for the treatment of a paper web, said device comprising:

at least one web guide roll, said guide roll being structured and arranged such that a web is wound around the guide roll in a controlled manner in the event of a disturbance;

wherein said guide roll is a suction roll; and wherein said suction roll is structured and arranged such that a constant slight vacuum is maintained in the suction roll in order to stabilize said web and a intensive vacuum is generated in the suction roll substantially at the time of said disturbance.

7. The device according to claim 6, wherein said suction roll is structured and arranged such that a vacuum is generated in the suction roll, said vacuum having a strength which is selected so that it is strong enough to suck a cut off final end of said web around the suction roll at a time of a reel change but said vacuum not being so strong so as to interfere with the run of the web during normal running.

8. The device according to claim 6, further comprising:

an air foil box for producing streams of air for guiding a cut-off end of the web so that said cut-off end is wound around the web guide roll.

9. The device according to claim 6, further comprising:

a plate member arranged near said web guide roll, said plate member extending substantially across the entire width of the web guide roll in the cross direction.

10. The device according to claim 9, wherein said plate member includes a first plate portion which extends in a running direction of the web, said plate member being arranged in spaced relation to the web.

11. The device according to claim 10, wherein said plate member includes a second plate portion which extends along a face of the web guide roll at a distance spaced from the web guide roll.

12. The device according to claim 11, wherein the plate member is provided with perforations to permit the flow of air through the plate member.

13. A device in a paper machine, coating machine, intermediate winder, unwind stand of a slitter winder, or in any other device for the treatment of a paper web, said device comprising:

at least one web guide roll, said guide roll being structured and arranged such that a web is wound around the guide roll in a controlled manner in the event of a disturbance;

wherein said guide roll is a suction roll; and a moistening jet structured and arranged to provide a face of the guide roll with a fluid film which promotes adhesion.

14. A device in a paper machine, coating machine, intermediate winder, unwind stand of a slitter winder, or in any other device for the treatment of a paper web, said device comprising:

at least one web guide roll, said guide roll being structured and arranged such that a web is wound around the guide roll in a controlled manner in the event of a disturbance;

wherein said guide roll is a suction roll;

an air foil box for producing streams of air for guiding a cut-off end of the web so that said cut-off end is wound around the web guide roll; and a carrier face structured and arranged to extend a distance around the web guide roll.

15. The device according to claim 14, wherein one of the streams of air nearest to a cutter blade for cutting the web is adapted to guide the cut-off final end of the web by means of a coanda effect into a space defined by the air foil box and the web guide roll and then around the web guide roll.

16. A device in a paper machine, coating machine, intermediate winder, unwind stand of a slitter winder, or in any other device for the treatment of a paper web, said device comprising:

at least one web guide roll, said guide roll being structured and arranged such that a web is wound around the guide roll in a controlled manner in the event of a disturbance;

wherein said guide roll is a suction roll; and a plate member arranged near said web guide roll, said plate member extending substantially across the entire width of the web guide roll in the cross direction;

wherein said plate member includes a first plate portion which extends in a running direction of the web, said plate member being arranged in spaced relation to the web;

wherein said plate member includes a second plate portion which extends along a face of the web guide roll at a distance spaced from the web guide roll;

wherein the plate member is provided with perforations to permit the flow of air through the plate member.

* * * * *